US008622487B2

(12) United States Patent
Jung

(10) Patent No.: US 8,622,487 B2
(45) Date of Patent: Jan. 7, 2014

(54) HOME APPLIANCE AND WASHING MACHINE

(75) Inventor: Hye Sun Jung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 12/588,953

(22) Filed: Nov. 3, 2009

(65) Prior Publication Data

US 2010/0109494 A1 May 6, 2010

Related U.S. Application Data

(60) Provisional application No. 61/112,078, filed on Nov. 6, 2008.

(30) Foreign Application Priority Data

Nov. 5, 2008 (KR) ..... 10-2008-0109548

(51) Int. Cl.
*A47B 17/04* (2006.01)

(52) U.S. Cl.
USPC ..... 312/204; 312/265.5

(58) Field of Classification Search
USPC ..... 312/204, 265.5, 265.6, 228, 311, 405; 428/166, 172, 542.2, 913.3, 203
See application file for complete search history.

(56) References Cited

U.S. PATENT DOCUMENTS 2,001,725 A * 5/1935 Harris ..... 428/67
5,429,857 A * 7/1995 Amemiya et al. ..... 428/156
5,496,104 A * 3/1996 Arnold et al. ..... 312/204
5,587,218 A * 12/1996 Betz ..... 428/67
5,698,287 A * 12/1997 Neiman ..... 428/66.5
6,136,416 A * 10/2000 Smith et al. ..... 428/172
6,387,468 B1 * 5/2002 Kim et al. ..... 428/67
6,564,908 B2 * 5/2003 Sanchez et al. ..... 187/414
6,753,068 B2 * 6/2004 Nakamura et al. ..... 428/172
6,840,773 B2 * 1/2005 Anderson et al. ..... 434/73
7,105,218 B1 * 9/2006 Klemm et al. ..... 428/68
7,481,957 B1 * 1/2009 Adickes ..... 264/261
8,025,951 B2 * 9/2011 Bourban et al. ..... 428/172
8,439,461 B2 * 5/2013 Kim ..... 312/405
2003/0091784 A1 * 5/2003 Nykamp et al. ..... 428/99
2004/0032797 A1 * 2/2004 Sato et al. ..... 368/232
2005/0017605 A1 * 1/2005 Bauer ..... 312/204

(Continued)

FOREIGN PATENT DOCUMENTS

DE 44 39 352 5/1996
DE 697 00 048 5/2000

(Continued)

OTHER PUBLICATIONS

English machine translation of JP2004330747 obtained on Sep. 12, 2012 from the Advanced Industrial Property Network of the Japan Patent Office at http://dossier1.ipdl.inpit.go.jp/AIPN/odse_top_dn.ipdl?N0000=7400.*

*Primary Examiner* — Daniel Rohrhoff
(74) *Attorney, Agent, or Firm* — McKenna Long & Aldridge LLP

(57) ABSTRACT

A home appliance and a washing machine are provided. With a configuration in which an ornament having a patterned portion on which a predetermined image is formed and a transparent member placed on an outer surface of the ornament are closely attached to each other, it is possible to prevent water from entering a gap between the ornament and the transparent member.

26 Claims, 14 Drawing Sheets

(56) References Cited

U.S. PATENT DOCUMENTS

| | | | | |
|---|---|---|---|---|
| 2006/0117813 | A1* | 6/2006 | Ha et al. | 68/196 |
| 2008/0203870 | A1* | 8/2008 | Riley et al. | 312/265.6 |
| 2010/0141102 | A1* | 6/2010 | Jung et al. | 312/204 |
| 2010/0295425 | A1* | 11/2010 | Kim | 312/204 |
| 2011/0089790 | A1* | 4/2011 | Lee et al. | 312/109 |
| 2011/0215688 | A1* | 9/2011 | Jang | 312/228 |

FOREIGN PATENT DOCUMENTS

| | | | |
|---|---|---|---|
| DE | 199 40 145 | | 3/2001 |
| DE | 10 2004 044 183 | | 3/2006 |
| JP | 2003-65668 | A | 3/2003 |
| JP | 2004330747 | A * | 11/2004 |
| KR | 10-2006-0128233 | A | 12/2006 |
| KR | 10-2008-0065096 | A | 7/2008 |

* cited by examiner

HOME APPLIANCE AND WASHING MACHINE

The present application claims priority to Korean Application No. 10-2008-0109548 filed in Korea on Nov. 5, 2008, and U.S. Patent Application No. 61/112,078 filed on Nov. 6, 2008 in US, the entire contents of which are hereby incorporated by reference in their entirety.

BACKGROUND OF THE INVENTION

1. Field of the Invention

The present invention relates to a home appliance and a washing machine, and more particularly, to a home appliance and a washing machine, in which a patterned ornament and a transparent member are closely attached to each other, achieving water-tight sealing therebetween.

2. Discussion of the Related Art

Generally, to arouse a user's aesthetic appreciation and to achieve harmony with surrounding environments, an external appearance defining part of a home appliance, called a body, cabinet, case, casing, or the like, is subjected to painting, coating, image printing, or the like.

For example, in the case of a laundry treating machine as one kind of a washing machine, an exterior panel is attached to an outer surface of a casing member that defines an external appearance of the machine, in order to improve aesthetics of the machine according to user demand for an aesthetic product. In particular, recently, aesthetics of a home appliance is no less important, as a judgment standard of purchase, than functionality or performance and thus, improving aesthetics of a product becomes important.

Conventionally, to improve aesthetics of a product, an image has been printed on the product using a silk screen. In this case, printing an image using the silk screen is unrelated to material characteristics of a member defining a printing surface and thus, has a limit in presentation of material texture of the member and creation of three-dimensional feeling.

Moreover, constituent elements of the exterior panel do not show close adhesion therebetween, causing invasion of water through the rim of the exterior panel.

SUMMARY OF THE INVENTION

An object of the present invention is to provide a home appliance and a washing machine, in which a flat rim of an ornament is closely attached to a transparent member, resulting in a sealed gap between the ornament and the transparent member.

The objects of the present invention are not limited to the above-mentioned object and other objects that have not mentioned above will become evident to those skilled in the art from the following description.

To achieve the above objects, there is provided a home appliance according to an exemplary embodiment of the present invention, including a frame defining an external appearance of the home appliance; and an exterior panel coupled to an outer surface of the frame, wherein the exterior panel includes an ornament having a patterned portion on which a predetermined image is formed, and a transparent member affixed to an outer surface of the ornament, and the ornament includes a flat surface portion for surface attachment with respect to the transparent member.

To achieve the above objects, there is provided a laundry treating machine according to another exemplary embodiment of the present invention, including a frame having a wash tub received therein, and an exterior panel coupled to an outer surface of the frame, wherein the exterior panel includes an ornament having a patterned portion on which an image is formed, and a transparent member integrally coupled to an outer surface of the ornament, and the ornament includes a flat surface portion for surface attachment with respect to the transparent member.

DETAILED DESCRIPTION OF THE PREFERRED EMBODIMENTS

Figure 1:
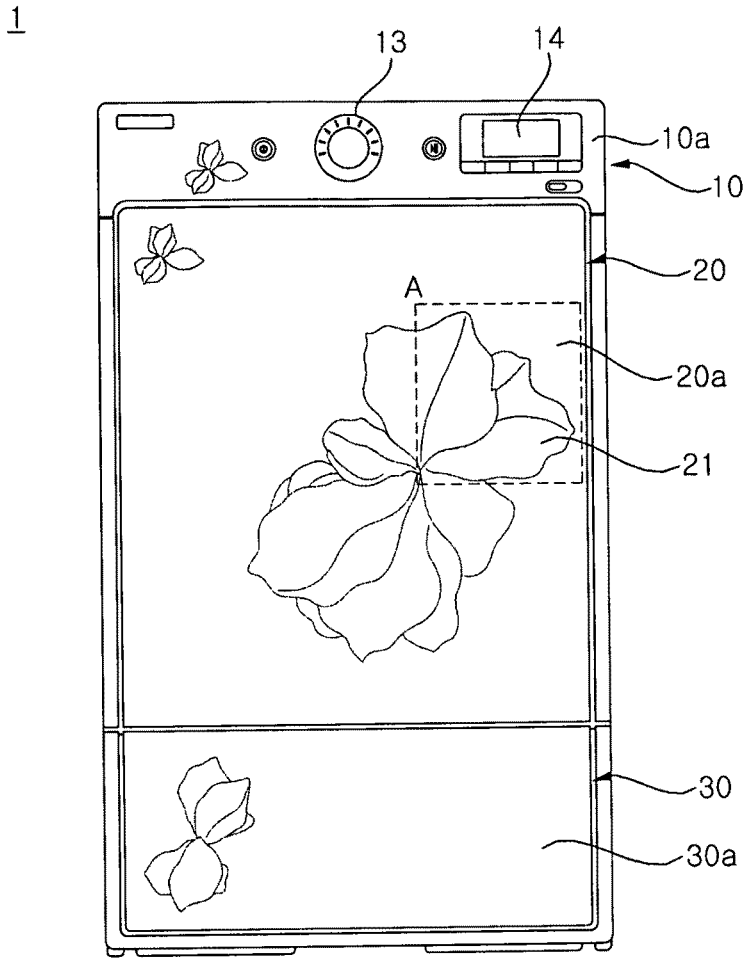
FIG. 1 is a front view showing a laundry treating machine according to a first embodiment of the present invention.

The advantages and features of the present invention, and the way of attaining them, will become apparent with reference to embodiments described below in conjunction with the accompanying drawings. However, the present invention is not limited to the embodiments disclosed below and will be embodied in a variety of different forms; rather, these embodiments are provided so that this disclosure will be thorough and complete, and will fully convey the scope of the present invention to those skilled in the art, and the scope of the present invention will be defined by the appended claims. Like reference numerals refer to like elements throughout the specification.

A home appliance of the present invention refers to an electric appliance used at home, such as a washing machine, refrigerator, television, or the like. In particular, a washing machine is designed to wash an object via washing, rinsing, spin-drying, drying operations, or the like. Based on the kind of an object to be washed, for example, washing machines may be classified into various kinds including a laundry treating machine and a dish washing machine. The laundry treating machine may include a washer, a dryer, a combined washing/drying machine, a spin-drier, and the like.

Although the following embodiments of the present invention describe a laundry treating machine 1 falling under the category of a washing machine, the present invention is not limited thereto and is applicable to a variety of washing machines. Furthermore, it is noted that the present invention is applicable to a variety of home appliances.

FIG. 1 is a front view showing the laundry treating machine 1 according to a first embodiment of the present invention. Referring to FIG. 1, the laundry treating machine 1 includes a body having a wash space (not shown) to wash laundry therein, a control unit 10 provided in an upper region of the body to control general operations of the laundry treating machine 1 upon receiving an operation command from a user, a door 20 to open or close a front side of the wash space, and a pedestal 30 provided in a lower region of the body to perform, e.g., drying, deodorization, and sterilization of shoes received therein.

The control unit 10 includes a display device 14 to display information related to general operations of the laundry treating machine 1. In one example, the display device 14 may be a Liquid Crystal Display (LCD) or a Light Emitting Diode (LED). The display device 14 serves to display an operation mode related to washing, rinsing, or spin-drying, a setting time or residual time of each operation mode, and the like. In addition, the control unit 10 further includes a user manipulation button 13 to allow the user to input an operation command. In one example, the user manipulation button 13 may take the form of a rotary encoder.

An external appearance defining part of a home appliance, which is called a body, case, cabinet, or the like (hereinafter, referred to as a "casing member"), is generally fabricated through injection molding. An injection molded article may allow an exterior panel to be attached to an outer surface thereof. In this case, to arouse a user's aesthetic appreciation, the exterior panel may be formed with an image 21, in the form of a figure, pattern, or the like, by printing or etching.

The laundry treating machine 1 according to the first embodiment of the present invention includes a plurality of exterior panels. The plurality of exterior panels may include a control unit exterior panel 10*a* to define an external appearance of the control unit 10, a door exterior panel 20*a* to define an external appearance of the door 20, and a pedestal exterior panel 30*a* to define an external appearance of the pedestal 30.

The control unit exterior panel 10*a* is coupled to an outer surface of a control unit casing member (not shown) defining a shape of the control unit 10. The door exterior panel 20*a* is coupled to an outer surface of a door casing member (not shown) defining a shape of the door 20. The pedestal exterior panel 30*a* is coupled to an outer surface of a pedestal casing member (not shown) defining a shape of the pedestal 13. The door casing member, control unit casing member, and pedestal casing member may be formed by injection molding, respectively.

Figure 2:
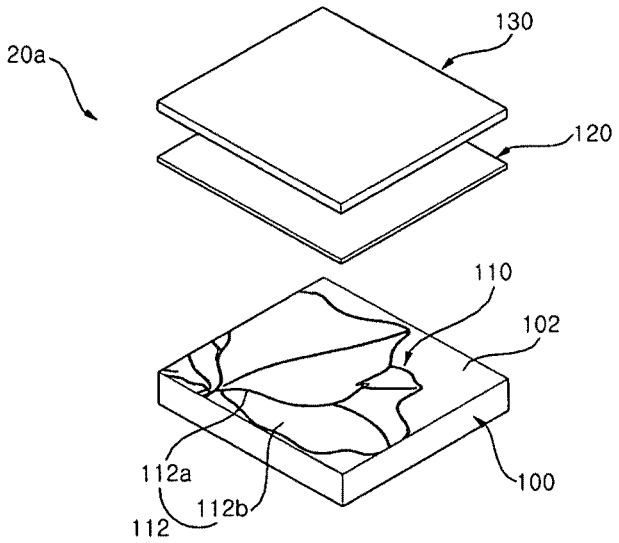
FIG. 2 is an enlarged perspective view of the partially cut-way portion A shown in FIG. 1, showing a door exterior panel of the laundry treating machine according to the first embodiment of the present invention.
Figure 3:
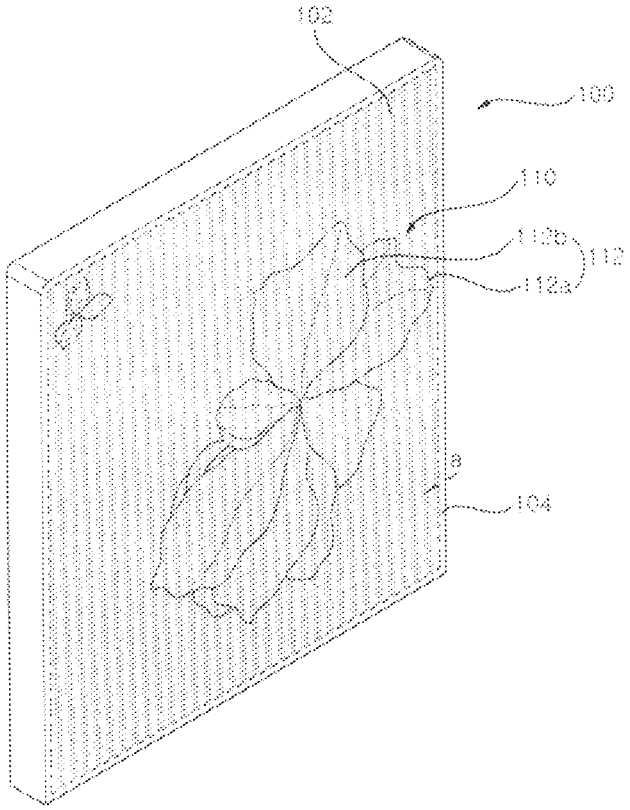
FIG. 3 is a perspective view showing an ornament of the laundry treating machine according to the first embodiment of the present invention.
Figure 4:
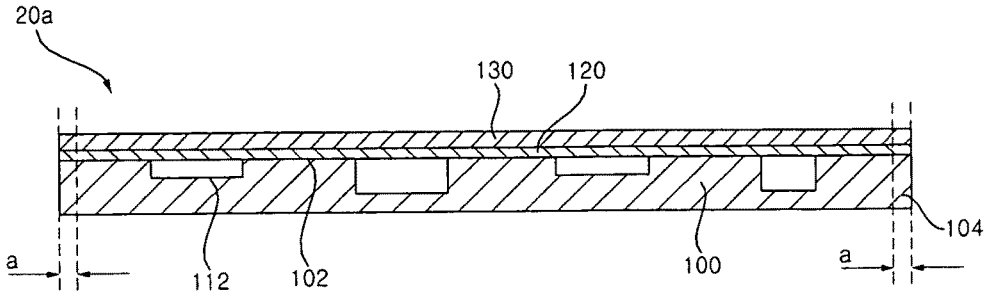
FIG. 4 is a sectional view of the door exterior panel of the laundry treating machine according to the first embodiment of the present invention.

FIG. 2 is an enlarged perspective view of the partially cut-way portion A shown in FIG. 1, showing the door exterior panel 20*a* of the laundry treating machine 1 according to the first embodiment of the present invention. FIG. 3 is a perspective view showing an ornament 100 of the laundry treating machine 1 according to the first embodiment of the present invention. FIG. 4 is a sectional view of the door exterior panel 20*a* of the laundry treating machine 1 according to the first embodiment of the present invention. Referring to FIG. 2, the door exterior panel 20*a* includes the ornament 100 on which an image is formed by an image processing technology, such as photo-etching, and a transparent member 130 coupled to a surface of the ornament 100 by means of an adhesive member 120.

The surface of the ornament 100 is formed with an image, in the form of a figure, pattern, or the like, so as to make the ornament 100 aesthetically pleasing. Specifically, the transparent member 130 serves as a protective coating layer on the surface of the ornament 100 to allow the ornament 100 to be seen from the outside.

The ornament 100 is preferably made of a metal, which can be easily photo-etched. When the ornament 100 is made of a metal, aesthetics of the ornament 100 can be improved by maximizing material texture of the metal via polishing or photo-etching. In particular, the ornament 100 may be made of stainless steel (hereinafter, referred to as "STS"). As is known, STS has excellent corrosion-resistance, durability, and reflectivity and is easily photo-etched. In addition, when STS is subjected to cutting or photo-etching, a processed surface of STS exhibits a high gloss that is peculiar to a metal, making an external appearance of a product look more luxurious.

In more detail, the ornament 100 is formed at the surface thereof with a plurality of hair lines 102. The hair lines 102 may be formed by polishing the surface of the ornament 100 in a given direction. Specifically, the hair lines 102 may be realized by a processing device that uses an abrasive sheet formed with appropriate sizes of particles. As the abrasive sheet is rotated at a high speed, the hair lines 102 of discontinuous pitches are formed on the surface of the ornament 100.

The hair lines 102 serve to maximize the material texture of the ornament 100, and have the effects of improving material texture of a metal by polishing, preventing glare via scattered reflection of indoor light, and creating a luxurious external appearance. In particular, although a smooth metal plate may cause irregular reflection light when it is slightly deformed by external shock thus having an unpleasing external appearance, processing hair lines on a metal surface can solve this problem.

The ornament 100 is further formed at the surface thereof with a patterned portion 110. The patterned portion 110 may be realized by photo-etching. Here, photo-etching is an ultra-precision processing technology and includes coating a photoresist film on a metal surface, exposing and developing a partial image by ultraviolet light, and then, etching the exposed metal surface.

In more detail, photo-etching is a combination of photolithography and etching. Photolithography includes applying a photoresist solution over a substrate to form a photoresist film, and selectively exposing and developing a partial image on the film by ultraviolet light having passed through a photomask (i.e. a patterned film).

Etching is a technology for selectively etching a material surface using a developed photoresist film as a protective film. Specifically, etching is one kind of a recess forming technology for perforating and cutting a recess in a metal surface where no protective film is present via electrolytic etching or chemical etching using an acid or alkali solution, ferric chloride solution, or the like.

After completing the etching of the metal surface as described above, a finishing process for removing the protective film using an alkali solution, organic solvent, or the like may be added.

The patterned portion 110 may be formed on the surface of the ornament 100 by photo-etching. Photo-etching allows delicate lines of approximately 0.02 mm~0.03 mm to be presented on the ornament 100.

Referring to FIGS. 2 to 4, the patterned portion 110 includes recesses 112 indented from a surrounding plane by etching. The recesses 112 consist of outline recesses 112*a* defining an outline of an image and plane recesses 112*b* defining a plane of the image. In the present embodiment, the patterned portion 110 wholly defines a petal-shaped image. An outline of the image is realized by the outline recesses 112*a*, and a plane of the image is realized by the plane recesses 112*b*.

The patterned portion 110 may be realized by photo-etching in a state wherein the hair lines 102 have been formed on the ornament 100. In this case, the outline recesses 112*a* are preferably deeper than the plane recesses 112*b* and the hair lines 102.

The patterned portion 110 may include a plurality of the recesses 112. Respective ones of the plurality of recesses 112 may have various depths and widths under control of an etching degree. The various depths and widths of the plurality of recesses 112 cause, e.g., differences in paths, reflection angles, and reflected amount of light, advantageously enabling creation of a three-dimensional image. In particular, various depths of spaces are created between the transparent member 130 coupled to the surface of the ornament 100 and the plurality of recesses 112, resulting in maximized three-dimensional effect.

Meanwhile, assuming that a plastic casing member formed by injection molding is subjected to mirror printing and thereafter, a transparent member made of reinforced glass is coated on the casing member, a printed surface of the injection molded casing member may scratch the transparent member during coating. More particularly, an outline of a printed image is generally defined by a thin and sharp line raised from a surrounding plane, thus acting to scratch the transparent member.

The laundry treating machine 1 according to the first embodiment of the present invention has an advantage of preventing the transparent member 130 from being scratched because the outline recesses 112*a* defining the outline of the image are deeply indented from the surrounding plane.

The transparent member 130 is made of a transparent material suitable to allow the patterned portion 110 and the hair lines 102 to be seen from the outside. The transparent material may be selected from reinforced glass, glass, a PolyCarbonate (PC) sheet, and the like.

The transparent member 130 is attached to the ornament 100 by use of the adhesive member 120. The adhesive member 120 may be made of Pressure Sensitive Adhesive (PSA). In a state wherein PSA is interposed between two objects to be coupled, PSA acts to attach the two objects to each other upon receiving a predetermined pressure. PSA can achieve desired adhesive strength even under conditions of a room temperature and low pressure and therefore, has an advantage of realizing attachment of an object without deformation of the object. The adhesive member 120 is seated over the hair lines 102 of the ornament 100, serving to attach the transparent member 130 and the ornament 100 to each other.

Although photo-etching employed in the first embodiment of the present invention includes coating a photoresist film on the ornament 100, exposing and developing a partial image on the film, and then, chemically etching the ornament 100, in an alternative embodiment, a desired shape of image may be directly sketched on the ornament 100 and thereafter, sand cutting may be performed along the sketched image. Of course, various other methods capable of etching an image in the ornament 100 may be applied without departing from the scope and spirit of the present invention.

With formation of the recesses 112, predetermined spaces are created between the transparent member 130 and the ornament 100, allowing the ornament 100 to exhibit different shadow effects and material textures according to viewing directions. That is, maximizing three-dimensional effect of the patterned portion 110 viewed from the outside is possible.

In more detail, a part of light directed to the door exterior panel 20*a* is reflected by a front surface of the transparent member 130, another part of the light is reflected by a front surface of the adhesive member 120 after passing through the transparent member 130, and another part of the light is reflected by the recesses 112 after passing through the adhesive member 120. In this case, maximized three-dimensional effect can be accomplished because the transparent member 130, the adhesive member 120, and the recesses 112 reflect the light at different angles. Moreover, further enhanced three-dimensional effect can be accomplished because of refraction of the light passing through the transparent member 130 and/or the adhesive member 120.

The ornament 100 is formed along a rim thereof with a flat surface portion 104 rather than being formed with the hair lines 102 or the patterned portion 110. The flat surface portion 104 is not affected by polishing of the hair lines 102 and also, is not affected by etching of the patterned portion 110.

The flat surface portion 104 is formed inward from the rim of the ornament 100 and has a width "a". When the transparent member 130 and the ornament 100 are attached to each other by use of the adhesive member 120, the flat surface portion 104 achieves surface attachment with respect to the adhesive member 120, having the effect of increasing an attachment area. Specifically, one surface of the adhesive member 120 is closely attached to the flat surface portion 104 of the ornament 100, and the other surface of the adhesive member 120 is closely attached to the transparent member 130, whereby a gap between the ornament 100 and the transparent member 130 can be sealed.

When the flat surface portion 104 is formed at the rim of the ornament 100 to achieve surface attachment with respect to the adhesive member 120 and in turn, the adhesive member 120 achieves surface attachment with respect to the transparent member 130, furthermore, coupling strength between the ornament 100 and the transparent member 130 can be enhanced. This has the effects of preventing the transparent member 130 from peeling off and also, preventing propagation of bacteria, such as mold, etc., due to water entering a gap between the transparent member 130 and the ornament 100.

Figure 5:
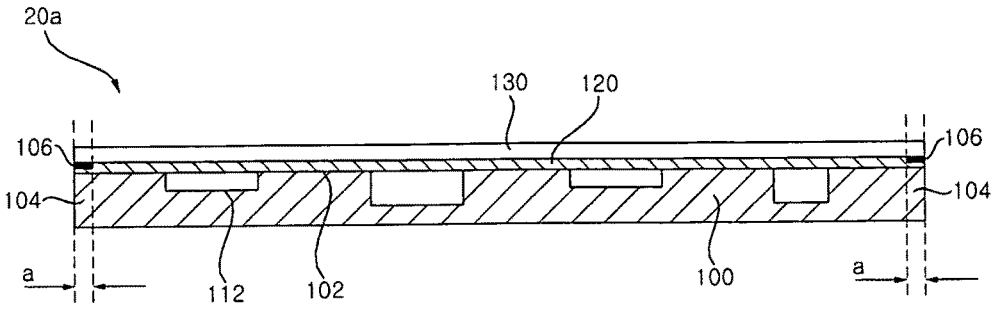
FIG. 5 is a sectional view of the door exterior panel of the laundry treating machine according to a second embodiment of the present invention.

FIG. 5 is a sectional view of the door exterior panel 20*a* of the laundry treating machine according to a second embodiment of the present invention. Hereinafter, a description of the same configurations as the above described first embodiment will be omitted.

Referring to FIG. 5, in a state wherein the ornament 100 is formed at the rim thereof with the flat surface portion 104, a first sealing member 106 may be inserted along the flat surface portion 104. Although FIG. 5 illustrates a configuration wherein the adhesive member 120 covers the entire upper surface of the ornament 100 including the flat surface portion 104 and the first sealing member 106 is seated on the adhesive member 120 along the flat surface portion 104, in an alternative embodiment, the adhesive member 120 may be placed to cover a partial surface of the ornament 100 except for the flat surface portion 104, and only the first sealing member 106 may be seated on the flat surface portion 104.

Preferably, the first sealing member 106 has a shape corresponding to that of the flat surface portion 104.

Figure 6:
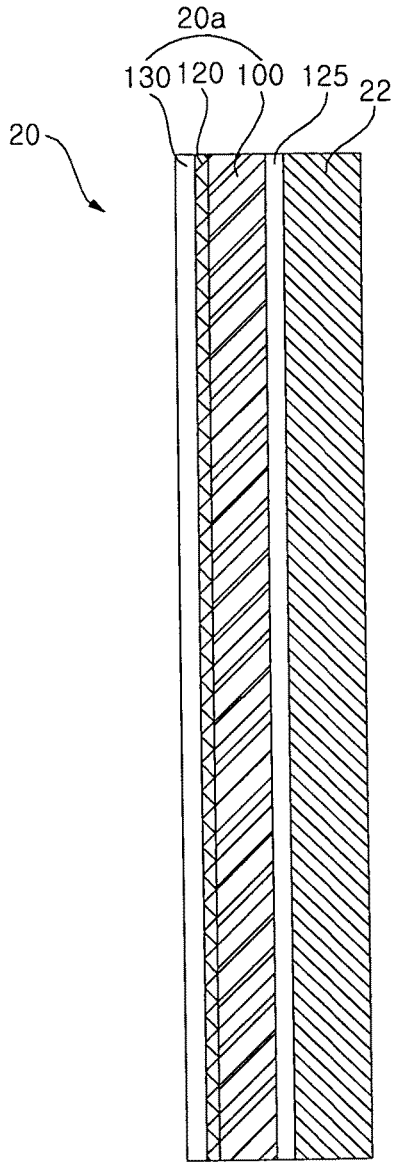
FIG. 6 is a sectional view showing a coupling relationship between the door exterior panel shown in FIG. 4 or 5 and a door casing member.

FIG. 6 is a sectional view showing a coupling relationship between the door exterior panel 20*a* shown in FIG. 4 or 5 and the door casing member 22. Referring to FIG. 6, as described above, the door exterior panel 20*a* is integrally formed such that the transparent member 130 and the ornament 100 are coupled to each other by use of the adhesive member 120. The door exterior panel 20*a* is coupled to the outer surface of the door casing member 22, completing formation of the door 20. In this case, the door exterior panel 20*a* may be attached to the door casing member 22 by use of a sealant or a double-sided tape 125. In particular, the sealant 125 is filled between the door exterior panel 20*a* and the door casing member 22 and can act to attach an object with excellent adhesive strength while exhibiting high water-resistance, strong cohesion for a long time, and less material deterioration and variation.

Figure 7:
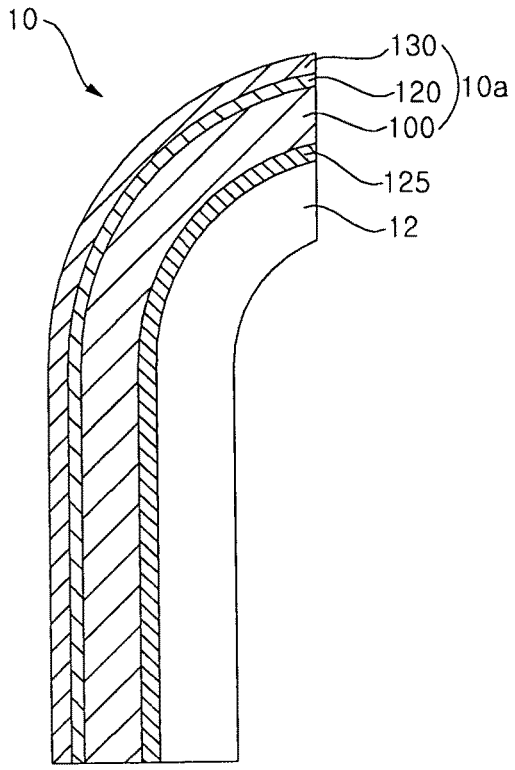
FIG. 7 is a sectional view showing a control unit of the laundry treating machine according to the first embodiment of the present invention.

FIG. 7 is a sectional view showing the control unit 10 of the laundry treating machine 1 according to the first embodiment of the present invention. The following description is given with reference to FIGS. 1 and 7.

Generally, a home appliance may have a curved surface portion. Although the exterior panel according to the present invention may be applied to a curved surface portion of the laundry treating machine 1, it will be appreciated that the use range of the exterior panel is not limited thereto and the exterior panel is applicable to curved surface portions of various home appliances. The present embodiment proposes the control unit exterior panel 10*a* as one example of the curved surface portion of the laundry treating machine 1. Of course, it is noted that the curved surface portion of the laundry treating machine 1 is not limited thereto.

Referring to FIG. 7, the control unit exterior panel 10*a* includes a curved surface portion. That is, the control unit exterior panel 10*a* has a shape corresponding to that of the rounded control unit casing member 12, so as to be closely attached to the control unit casing member 12.

The control unit 10 has the same configuration as that of the door 20. Specifically, the control unit 10 is configured such that the control unit exterior panel 10*a* is coupled to the control unit casing member 12 and in turn, the control unit exterior panel 10*a* is integrally formed such that the transparent member 130 and the ornament 100 are attached to each other.

Considering the fabrication of the control unit 10, first, the control unit casing member 12 is fabricated. In one example, the control unit casing member 12 may be fabricated by injection molding of plastic. The injection molding may include preparing a mold having a curved portion and injecting plastic into the mold.

The ornament 100 is preferably made of a metal, which can be easily etched. Similar to the ornament 100 of the door exterior panel 20*a* according to the above described first embodiment, the ornament 100 may be formed with the patterned portion by photo-etching. The ornament 100 is subjected to bending such that an inner surface of the ornament 100 is closely attached to the outer surface of the control unit casing member 12. Similarly, the transparent member 130 is subjected to bending such that an inner surface of the transparent member 130 is closely attached to an outer surface of the ornament 100. In this way, adjacent surfaces of the transparent member 130, the ornament 100, and the control unit casing member 12 are closely attached to one another.

The control unit exterior panel 10*a* is coupled to the control unit casing member 12 by use of a sealant or a double-sided tape 125. The sealant 125 has a predetermined thickness and elasticity, exhibiting excellent close-contact with respect to a curved surface portion.

Figure 8:
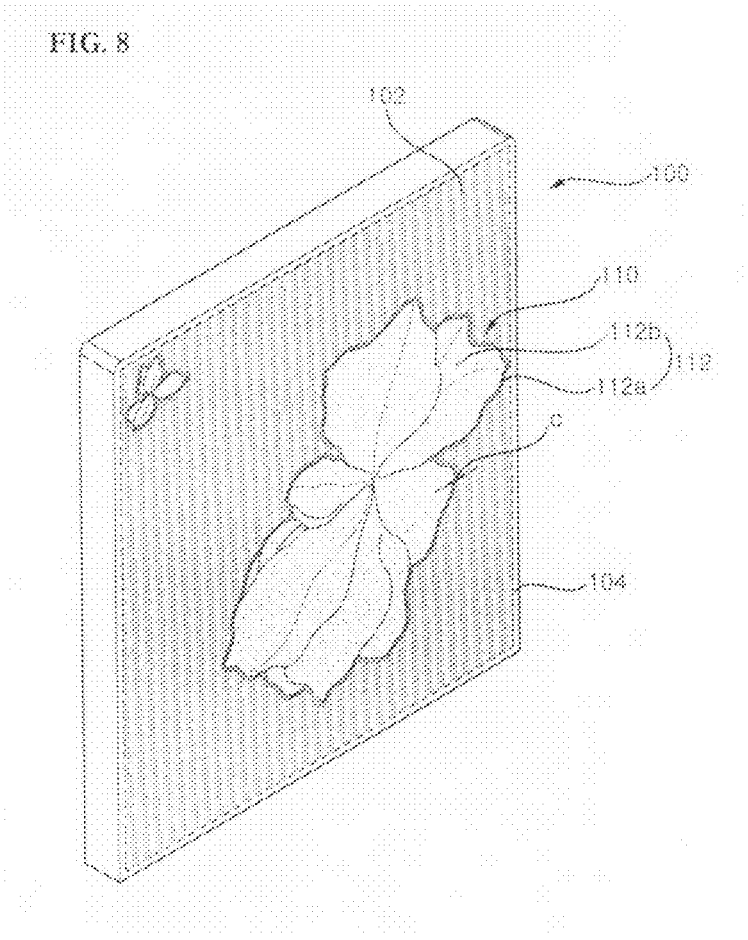
FIG. 8 is a perspective view showing the ornament of the laundry treating machine according to a third embodiment of the present invention.
Figure 9:
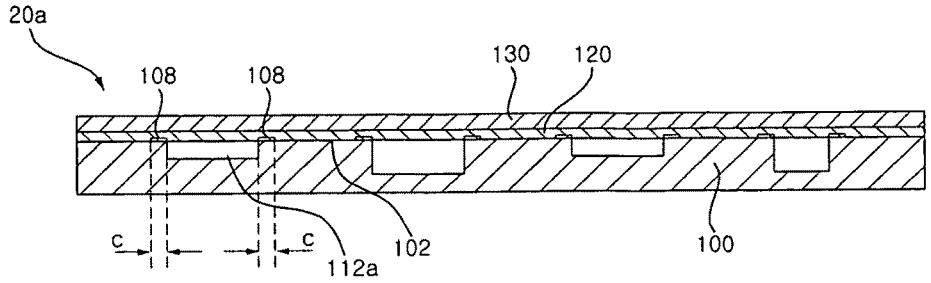
FIG. 9 is a sectional view of the door exterior panel of the laundry treating machine according to the third embodiment of the present invention.

FIG. 8 is a perspective view showing the ornament 100 of the laundry treating machine according to a third embodiment of the present invention. FIG. 9 is a sectional view of the door exterior panel 20*a* of the laundry treating machine according to the third embodiment of the present invention. Hereinafter, a description of the same configurations as the above described embodiments will be omitted. Referring to FIGS. 8 and 9, a second sealing member 108 is provided between the adhesive member 120 and the ornament 100. The second sealing member 108 may take the form of a film.

The second sealing member 108 is placed along an edge of the outline recess 112*a* of the patterned portion 110 and has a line width "c". The adhesive member 120 is closely attached to the ornament 100 by use of the second sealing member 108. Since the transparent member 130 is coupled to the surface of the adhesive member 120, a gap between the transparent member 130 and the ornament 100 can be sealed.

This may prevent the transparent member 130 from peeling off from the adhesive member 120 and also, may prevent water from entering between the transparent member 130 and the ornament 100 and thereby being introduced into the recess 112.

Figure 10:
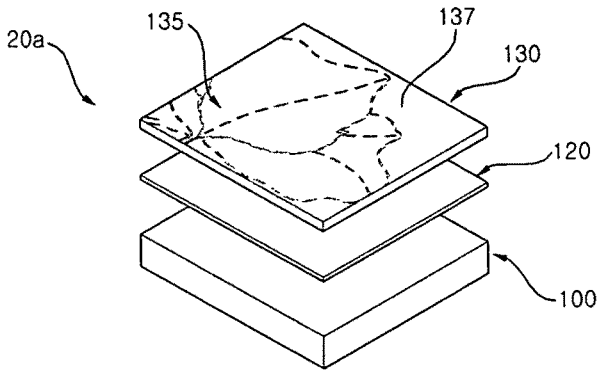
FIG. 10 is a partially cut-away perspective view of the door exterior panel of the laundry treating machine according to a fourth embodiment of the present invention.

FIG. 10 is a partially cut-away perspective view of the door exterior panel 20*a* of the laundry treating machine according to a fourth embodiment of the present invention. Referring to FIG. 10, the door exterior panel 20*a* includes the transparent member 130 formed with a patterned portion 135 on which a unique image is realized for improving aesthetics of the ornament 100. Differently from the patterned portion 130 formed at the ornament 100 of the above described embodiments, the patterned portion 135 according to the present embodiment is characterized by being formed at a surface of the transparent member 130. The patterned portion 135 may be realized by photo-etching, in the same manner as the above described first embodiment of the present invention. Although FIG. 10 illustrates the patterned portion 135 formed at a lower surface of the transparent member 130, the patterned portion 135 may also be formed at an upper surface of the transparent member 130.

Preferably, the patterned portion 135 is recessed in the lower surface of the transparent member 130 to create a predetermined space between the transparent member 130 and the ornament 100. The ornament 100 is preferably made of a metal, such as STS. That is, the patterned portion 135 recessed in the lower surface of the transparent member 130 provides enhanced material texture of metal and three-dimensional effect.

The patterned portion 135 may be realized on the surface of the transparent member 130 by silk screen printing. The transparent member 130 may be formed with hair lines 137 by the same method as the above described first embodiment.

Figure 11:
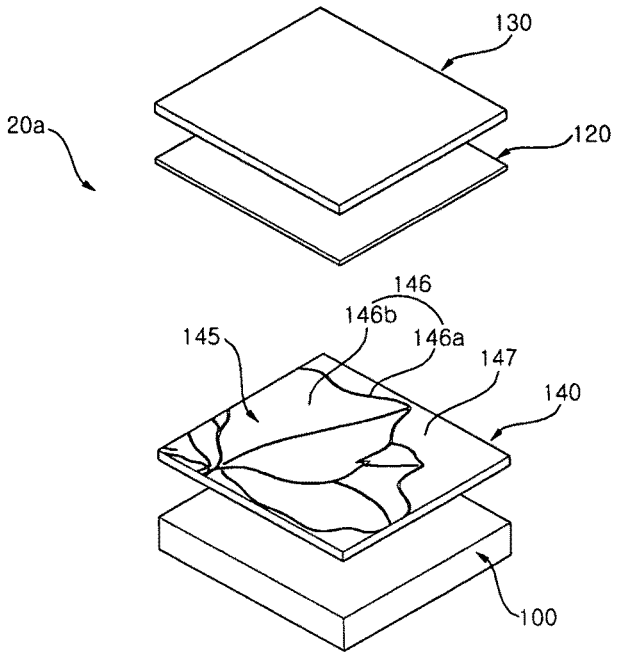
FIG. 11 is a partially cut-away perspective view of the door exterior panel of the laundry treating machine according to a fifth embodiment of the present invention.

FIG. 11 is a partially cut-away perspective view of the door exterior panel 20*a* of the laundry treating machine according to a fifth embodiment of the present invention. Referring to FIG. 11, the door exterior panel 20*a* according to the fifth embodiment of the present invention includes a printed layer 140 placed on the ornament 100, on which an image, in the form of a figure, pattern, or the like, is printed. The printed layer 140 is interposed between the adhesive member 120 and the ornament 100. That is, the adhesive member 120 is placed on the printed layer 140.

The printed layer 140 may be realized using a transfer-printed film or by silk screen printing. The printed layer 140 includes a patterned portion 145 formed by etching a surface of the printed layer 140. The printed layer 140 may be formed with hair lines 147, and the patterned portion 145 includes recesses 146, the hair lines 147*a* and the recesses 146 having the same configurations as the above described first embodiment.

The ornament 100 is preferably made of a metal, and the printed layer 140 is preferably made of a transparent material to allow metallic material texture of the ornament 100 to be seen from the outside. The printed layer 140 may be made of a transparent colored material. In this case, with cooperation of the color of the printed layer 140 and the metallic material texture of the ornament 100, enhanced aesthetics of the ornament 100 can be realized.

Figure 12:
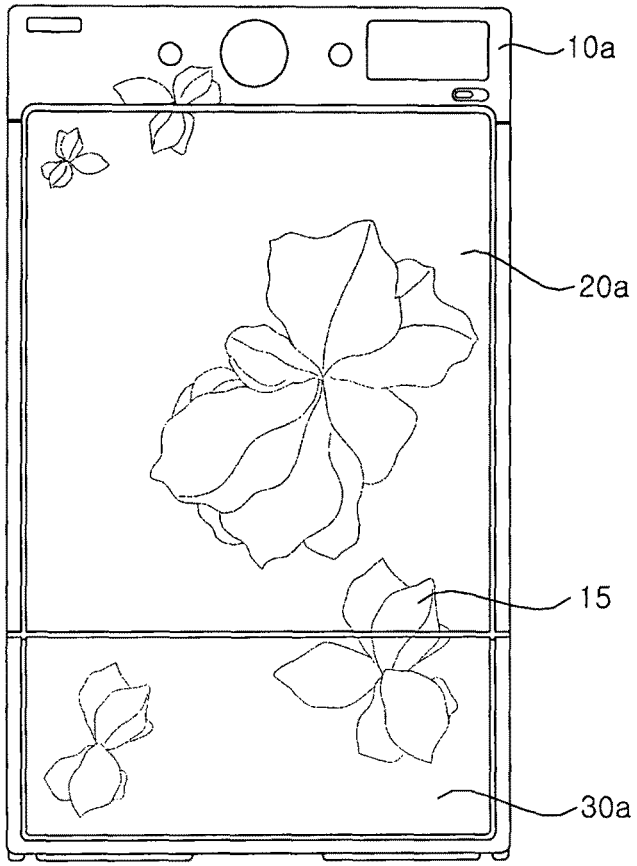
FIG. 12 is a front view showing exterior panels of the laundry treating machine according to the first embodiment of the present invention.

FIG. 12 is a front view showing exterior panels of the laundry treating machine 1 according to the first embodiment of the present invention. Referring to FIGS. 1 and 12, as described above, the exterior panels include the control unit exterior panel 10*a*, the door exterior panel 20*a*, and the pedestal exterior panel 30*a*.

In this case, the control unit exterior panel 10*a*, the door exterior panel 20*a*, and the pedestal exterior panel 30*a* may be formed as a single body. In one example, after a single exterior panel is patterned to form an image, the patterned exterior panel may be split into the control unit exterior panel 10*a*, the door exterior panel 20*a*, and the pedestal exterior panel 30*a*.

The above described exterior panel fabrication method of splitting the single patterned panel into the control unit exterior panel 10*a*, the door exterior panel 20*a*, and the pedestal exterior panel 30*a* has an advantage of easily realizing a continuous image throughout a plurality of adjacent panels. For example, referring to FIG. 12, a part of an image 15 belongs to the door exterior panel 20*a*, but the remaining part belongs to the pedestal exterior panel 30*a*. For this, after the image 15 is formed by photo-etching in a state wherein the door exterior panel 20*a* and the pedestal exterior panel 30*a* are formed as a single body, cutting of the single body is performed, enabling easy realization of the image 15. In particular, realizing the continuous image 15 on the neighboring panels, i.e. the door exterior panel 20*a* and the pedestal exterior panel 30*a*, may advantageously arouse unity and coordination, resulting in visual stability.

Of course, it is not essential that the control unit exterior panel 10*a*, the door exterior panel 20*a*, and the pedestal exterior panel 30*a* be formed as a single body. For example, an exterior panel having a curved surface portion, such as the control unit exterior panel 10*a* shown in FIG. 7, may be separately fabricated.

Figure 13:
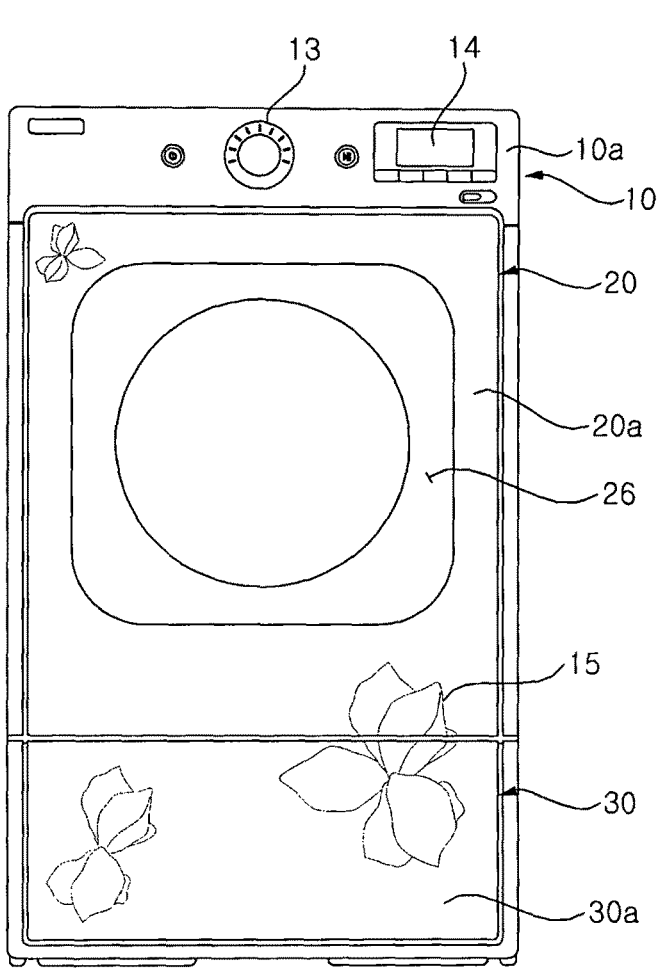
FIG. 13 is a front view showing a laundry treating machine according to a sixth embodiment of the present invention.
Figure 14:
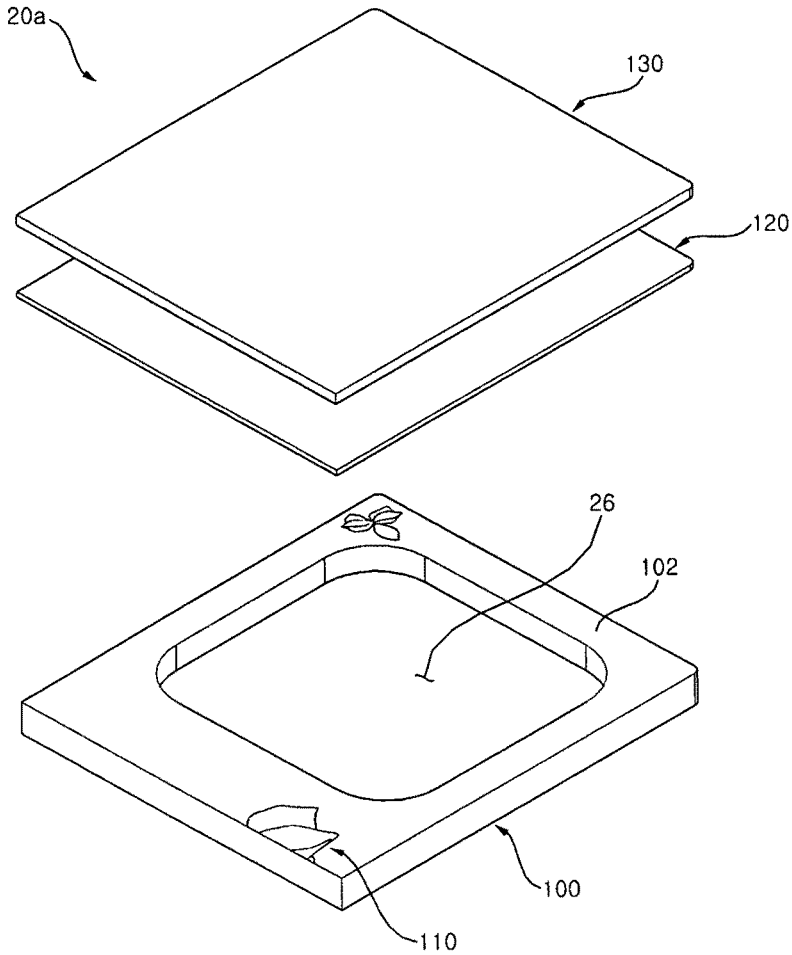
FIG. 14 is an exploded perspective view showing a configuration of the door exterior panel shown in FIG. 13.

FIG. 13 is a front view showing a laundry treating machine 2 according to a sixth embodiment of the present invention. FIG. 14 is an exploded perspective view showing a configuration of the door exterior panel 20*a* shown in FIG. 13. In the following description with reference to FIGS. 13 and 14, the same configurations as the above described embodiments will not be described.

The laundry treating machine 2 according to the sixth embodiment of the present invention includes an observation window provided at the door 20. The user is able to observe the interior of a wash tub (not shown) through the observation window.

The door 20 includes the door casing member (not shown) having an opening perforated in an approximately central position thereof, and the door exterior panel 20*a* coupled to the outer surface of the door casing member. Similar to the above described first embodiment, the door exterior panel 20*a* takes the form of a stack of the transparent member 130 and the ornament 100, and the ornament 100 includes the patterned portion 110. In the present embodiment, the ornament 100 has an observation hole 26 at a position corresponding to the opening of the door casing member.

The door casing member (not shown) attached to a rear surface of the door exterior panel 20*a* may have an inwardly curved surface portion. The inwardly curved surface portion has the effect of providing improved three-dimensional feeling when viewing the inwardly curved surface portion through the observation hole 26.

With relation to the patterned portion 110 formed at the ornament 100, the patterned portion 110 is formed using the same method as the above described embodiments.

It will be understood by those skilled in the art that example embodiments can be implemented in other specific forms without changing the technical spirit or essential features of the present invention. Therefore, it should be noted that the forgoing embodiments are merely illustrative in all aspects and are not to be construed as limiting the invention. The scope of the invention is defined by the appended claims rather than the detailed description of the invention. All changes or modifications or their equivalents made within the meanings and scope of the claims should be construed as falling within the scope of the invention.

According to a home appliance and a washing machine of the present invention, one or more effects as follows may be achieved.

First, as a result of providing an ornament with a patterned portion on which an image is formed and closely attaching a transparent member to a surface of the ornament, enhanced material texture and three-dimensional feeling can be accomplished, arousing a user's aesthetic appreciation.

Second, the ornament is provided at a rim thereof with a flat surface portion for surface attachment with respect to the transparent member. This can achieve sealing between the ornament and the transparent member.

Third, affixing the transparent member to the ornament has the effect of reinforcing the strength of an exterior panel.

The effects of the present invention are not limited to the above-mentioned effects, and other effects not mentioned above can be clearly understood from the definitions in the claims by one skilled in the art.

What is claimed is:

1. A home appliance comprising:

at least one casing member defining an external appearance of the home appliance; and an exterior panel coupled to an outer surface of the casing member, such that the exterior panel closely follows the contour of the casing member, wherein the exterior panel includes:

an ornament having a patterned portion on which an image is formed and a flat surface portion;

a transparent member integrally coupled to an outer surface of the ornament;

an adhesive member interposed between the transparent member and the ornament to enable surface attachment between the transparent member and the flat surface portion of the ornament;

a printed layer interposed between the adhesive member and the ornament; and sealing member seated on the flat surface portion, to seal between the transparent member and the ornament, wherein:

the casing member includes a curved surface portion; and the exterior panel is subjected to bending, so as to follow the contour of curved surface portion.

2. The home appliance of claim 1, wherein the flat surface portion is formed inward from a rim of the ornament and has a predetermined width.

3. The home appliance of claim 1, wherein the adhesive member includes Pressure Sensitive Adhesive (PSA).

4. The home appliance of claim 1, wherein the ornament includes a hair line formed by polishing a surface of the ornament except for the flat surface portion.

5. The home appliance of claim 1, wherein the patterned portion is formed by photo-etching a surface of the ornament.

6. The home appliance of claim 5, wherein the photo-etching includes: a photolithography process to form a pattern; and an etching process to etch the ornament based on the pattern.

7. The home appliance of claim 5, wherein the patterned portion includes at least one recess formed by the photo-etching.

8. The home appliance of claim 7, wherein:

the at least one recess includes a plurality of recesses; and the plurality of recesses includes two or more recesses having different depths.

9. The home appliance of claim 1, wherein the patterned portion includes an outline recess indented from a surrounding plane to define an outline of the image.

10. The home appliance of claim 1, wherein the ornament includes stainless steel.

11. The home appliance of claim 1, wherein the casing member and the ornament are coupled to each other by use of a sealant or a double-sided tape.

12. The home appliance of claim 1, wherein:

the exterior panel includes a window; and the window includes an observation hole perforated in the ornament.

13. The home appliance of claim 1, wherein:

the at least one casing member includes a plurality of casing members; and the exterior panel is formed as a single body, so as to be mounted to the plurality of casing members.

14. A washing machine comprising:

at least one casing member having a wash tub received therein; and an exterior panel coupled to an outer surface of the casing member, such that the exterior panel closely follows the contour of the casing member, wherein the exterior panel includes:

an ornament having a patterned portion on which an image is formed and a flat surface portion;

a transparent member integrally coupled to an outer surface of the ornament, an adhesive member interposed between the transparent member and the ornament to enable surface attachment between the transparent member and the flat surface portion of the ornament;

a printed layer interposed between the adhesive member and the ornament; and sealing member seated on the flat surface portion, to seal between the transparent member and the ornament, wherein:

the casing member includes a curved surface portion; and the exterior panel is subjected to bending, so as to follow the contour of curved surface portion.

15. The washing machine of claim 14, wherein the flat surface portion is formed inward from a rim of the ornament and has a predetermined width.

16. The washing machine of claim 14, wherein the adhesive member includes Pressure Sensitive Adhesive (PSA).

17. The washing machine of claim 14, wherein the ornament includes a hair line formed by polishing a surface of the ornament except for the flat surface portion.

18. The washing machine of claim 14, wherein the patterned portion is formed by photo-etching a surface of the ornament.

19. The washing machine of claim 18, wherein the photo-etching includes: a photolithography process to form a pattern; and an etching process to etch the ornament based on the pattern.

20. The washing machine of claim 18, wherein the patterned portion includes at least one recess formed by the photo-etching.

21. The washing machine of claim 20, wherein:

the at least one recess includes a plurality of recesses; and the plurality of recesses includes two or more recesses having different depths.

22. The washing machine of claim 14, wherein the patterned portion includes an outline recess indented from a surrounding plane to define an outline of the image.

23. The washing machine of claim 14, wherein the ornament includes stainless steel.

24. The washing machine of claim 14, wherein the casing member and the ornament are coupled to each other by use of a sealant or a double-sided tape.

25. The washing machine of claim 14, wherein:

the casing member is a door casing member to open or close the wash tub;

the exterior panel is a door exterior panel coupled to an outer surface of the door casing member;

the door exterior panel includes a window; and the window includes an observation hole perforated in the ornament.

26. The washing machine of claim 14, wherein:

the at least one casing member includes a plurality of casing members; and the exterior panel is formed as a single body, so as to be mounted to the plurality of casing members.

* * * * *